US006739146B1

(12) United States Patent
Davis et al.

(10) Patent No.: US 6,739,146 B1
(45) Date of Patent: May 25, 2004

(54) ADAPTIVE DEFROST CONTROL FOR A REFRIGERATOR

(75) Inventors: Kenneth E. Davis, Berwyn, IL (US); Alvin V. Miller, Swisher, IA (US); Joseph H. Ryner, New Windsor, IL (US); Kyle B. VanMeter, Galesburg, IL (US); Robert L. Wetekamp, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,691

(22) Filed: Mar. 12, 2003

(51) Int. Cl.[7] ..... F25D 21/06; F25D 21/00
(52) U.S. Cl. ..... 62/155; 62/234
(58) Field of Search ..... 62/155, 153, 156, 62/154, 234, 276, 277

(56) References Cited

U.S. PATENT DOCUMENTS 3,899,895 A * 8/1975 Blanton et al. ..... 62/155
4,297,852 A * 11/1981 Brooks ..... 62/153
5,564,286 A * 10/1996 Suse ..... 62/153
5,887,443 A * 3/1999 Lee et al. ..... 62/153
6,606,870 B2 * 8/2003 Holmes et al. ..... 62/155

* cited by examiner

*Primary Examiner*—Chen Wen Jiang
(74) *Attorney, Agent, or Firm*—Diederiks & Whitelaw, PLC

(57) ABSTRACT

A defrost control system for a refrigerator having freezer and fresh food compartments includes a plurality of temperature sensors, a plurality of door sensors to provide signals indicative of the occurrence of a door opening condition, a memory to store the signals in a plurality of usage blocks, and a CPU or controller to categorize the usage blocks into periods of high and low usage. When a defrost cycle is required, the control system establishes the cycle at an upcoming period designated as one of low usage. Additionally, prior to activating the system, the controller lowers the temperature of at least the freezer compartment to below a set point. The controller establishes the defrost cycle for a period based upon the time duration of previously completed cycles.

20 Claims, 3 Drawing Sheets

ADAPTIVE DEFROST CONTROL FOR A REFRIGERATOR

BACKGROUND OF THE INVENTION

1. Field of Invention

The present invention pertains to the art of refrigerated appliances and, more particularly, to a refrigerator having an adaptive defrost cycle wherein the defrost cycle is operated during periods of low use as determined by a controller upon receiving signals representative of door opening patterns.

2. Discussion of Prior Art

Refrigerated appliances, for both commercial and domestic applications, utilize a refrigeration system typically including, but not limited to, a compressor, a condenser and an evaporator. During operation, water vapor condenses on the evaporator and may freeze. The ensuing ice or frost accumulation significantly reduces the amount of air which can flow through the evaporator unit resulting in a diminished capacity to cool the appliance efficiently. In order to reduce the effects of frost build-up on the evaporator, refrigerated appliances often incorporate a operating cycle designed to periodically defrost the evaporator, thereby renewing the evaporator's ability to operate efficiently.

Early defrost cycles simply de-activated the refrigeration system for a period of time so that temperature of the unit would rise and the frost build up would melt away. However, this method required substantial time and could cause the temperature in the appliance to rise to the point that food contained therein would be damaged. Later appliances incorporated a defrost heater mounted adjacent to the evaporator which, when operated, would hasten the process and thereby reduce the impact on internal appliance temperatures. Once a shorter defrost cycle was developed, determining the optimal time to operate the cycle, and reducing the impact on food contained within the appliance became important.

There are various methods utilized to determine the best time to operate defrost cycles. For example, manufactures have provided sensors mounted to the evaporator to provide an indication of frost accumulation, or a controller is provided to count the operating hours of the compressor such that the defrost cycle was activated when a pre-determined time period was achieved. Other methods include load monitors to determine periods of reduced energy consumption to provide an indication of low use. However, this method would not account for leaks in the system or other anomalies that provided a false indication of low usage. The prior art also discloses the use of sensors to monitor and count an opening condition of a door to provide an indication of a cooling load required by the appliance. While there exist many methods of determining an appropriate time to activate the defrost cycle, there still exists an need for controller that can determine actual periods of low usage such that the defrost cycle is operated at times which have the least impact on food articles stored in the refrigerator.

SUMMARY OF THE INVENTION

A refrigerated appliance constructed in accordance with the present invention includes, in addition to an overall refrigeration system, a controller, at least one door sensor which provides signals indicative of opening conditions of a door of the appliance and a memory for storing the signals. The controller groups the signals stored in the memory into usage blocks. For instance, each hour of a day has a designated usage block which is further grouped into periods of low use and high use. When a defrost condition is indicated, the controller looks to activate the defrost system during periods of low use, preferably during the period of least usage.

In accordance with another aspect of the invention, a stirring fan mounted within a fresh food compartment is operated continuously during the defrost cycle to re-circulate cooling air throughout the compartment such that the temperature of the food contained within the compartment is not adversely affected.

In accordance with another aspect of the invention, the controller will lower the temperature set point of the freezer compartment prior to activation of the defrost system. In this manner, temperature loss during the defrost cycle will not cause the temperature of the freezer compartment to rise above the temperature set point, which could adversely impact the food contained therein.

Finally, the control will determine the optimal interval between successive defrost cycles, as well as the duration of each defrost cycle, based upon previously completed cycles. The controller stores in memory information relating to the time duration and interval between each prior defrost. If the previous cycle was shorter than a predetermined period, thus indicating that frost build-up was minimal, the controller will allow a longer interval between successive activations of the defrost system. In this manner, the controller can optimize the defrost operation such that food within the system is not subject to constant temperature variations.

In any event, additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF THE INVENTION

Figure 1:
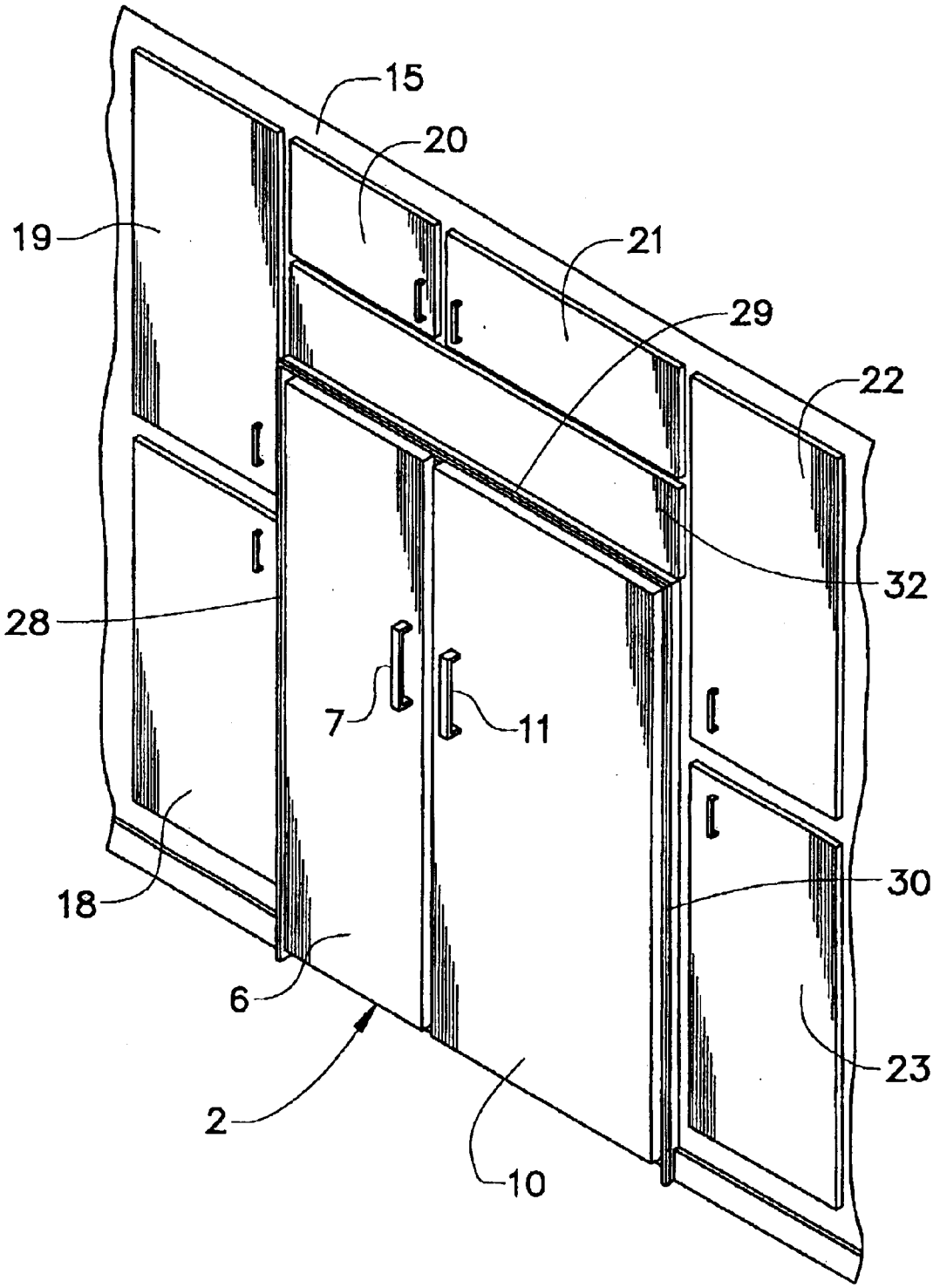
FIG. 1 is a front view of a refrigerator employing the adaptive defrost control system of the invention.

With initial reference to FIG. 1, a refrigerator constructed in accordance with the present invention is generally shown at 2. Refrigerator 2 is shown to include a freezer door 6 having an associated handle 7 and a fresh food door 10 having an associated handle 11. In the embodiment shown, refrigerator 2 is of the recessed type such that, essentially, only freezer and fresh food doors 6 and 10 project forward of a wall 15. The remainder of refrigerator 2 is recessed within wall 15 in a manner similar to a plurality of surrounding cabinets generally indicated at 18–23. Refrigerator 2 also includes a plurality of peripheral trim pieces 28–30 to blend refrigerator 2 with cabinets 18–23. One preferred embodiment employs trim pieces 28–30 as set forth in U.S. Patent Application entitled "Fastening System for Appliance Cabinet Assembly" filed on even date herewith and which is incorporated herein by reference. Finally, as will be described more fully below, refrigerator 2 is preferably designed with main components of a refrigeration system positioned behind an access panel 32 arranged directly above trim piece 29.

Figure 2:
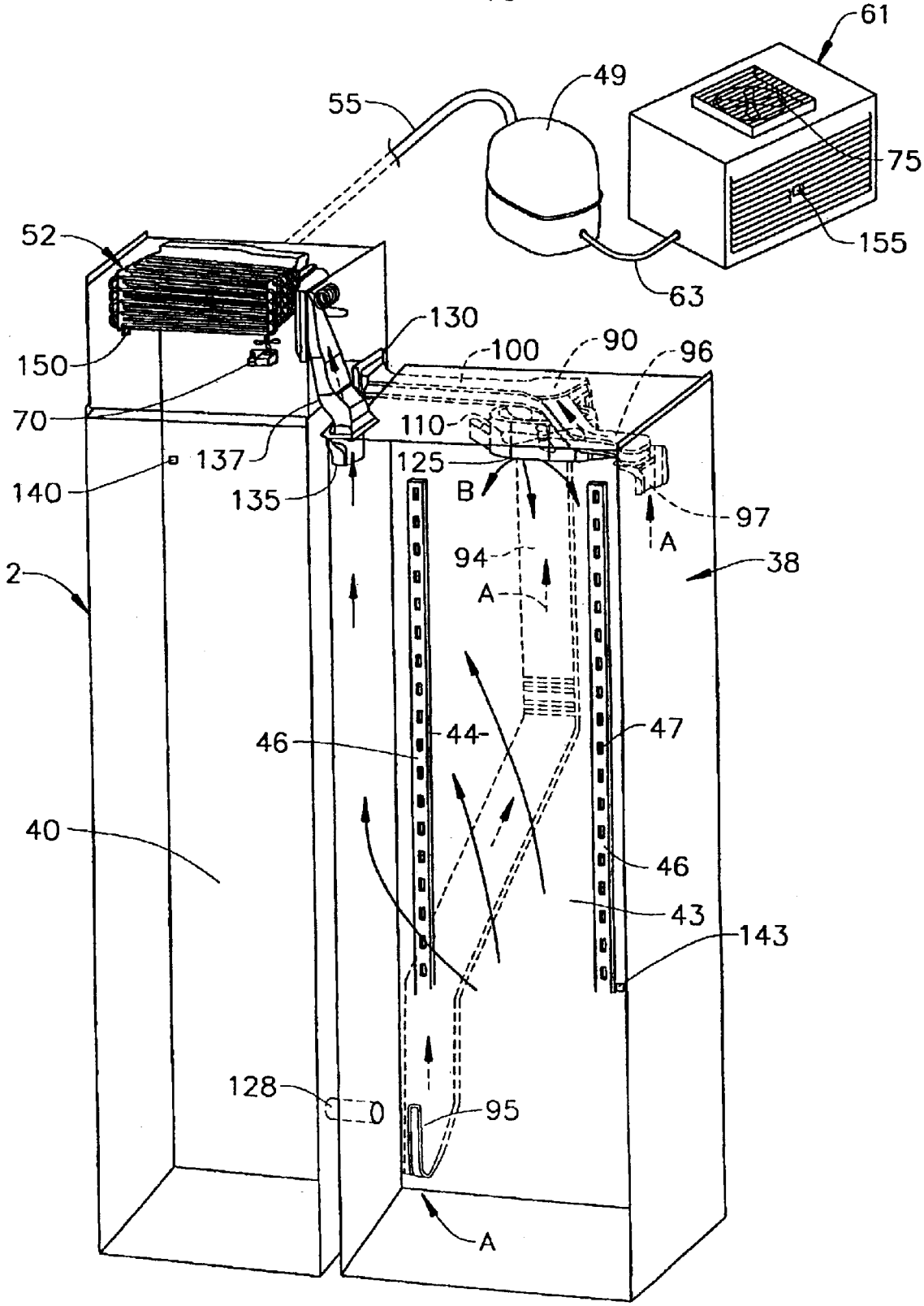
FIG. 2 is a partially exploded view showing various refrigeration system components of the invention.

As shown in FIG. 2, refrigerator 2 includes a cabinet shell 38 defining a freezer compartment 40 and a fresh food compartment 43. For details of the overall construction of cabinet shell 38, reference is again made to U.S. Patent Application entitled "Fastening System for Appliance Cabinet Assembly" filed on even date herewith and incorporated by reference. Shown arranged on a rear wall 44 of fresh food compartment 43 are a plurality of elongated metal shelf rails 46. Each shelf rail 46 is provided with a plurality of shelf support points, preferably in the form of slots 47, adapted to accommodate a plurality of vertically adjustable, cantilevered shelves (not shown) in a manner known in the art. Since the manner in which such shelves can vary and is not considered part of the present invention, the shelves have not been depicted for the sake of clarity of the drawings and will not be discussed further here. However, for purposes which will be set forth further below, it should be noted that each of rails 46 preferably extends from an upper portion, through a central portion, and down into a lower portion (each not separately labeled) of fresh food compartment 43.

Preferably mounted behind access panel 32 are components of the refrigeration system employed for refrigerator 2. More specifically, the refrigeration system includes a variable speed compressor 49 which is operatively connected to both an evaporator 52 through conduit 55, and a condenser 61 through conduit 63. Arranged adjacent to evaporator 52 is an evaporator fan 70 adapted to provide airflow to evaporator 52. Similarly, arranged adjacent to condenser 61 is a condenser fan 75 adapted to provide an airflow across condenser 61.

In addition to the aforementioned components, mounted to an upper portion of fresh food compartment 43 is an air manifold 90 for use in directing a cooling airflow through fresh food compartment 43 of refrigerator 2. More specifically, a first recirculation duct 94 having an inlet 95 exposed in a lower portion of fresh food compartment 43, a second recirculation duct 96 having an inlet 97 exposed at an upper portion of fresh food compartment 43, and an intake duct 100 establishing an air path for a flow of fresh cooling air from freezer compartment 40 into manifold 90. Arranged in fluid communication with air manifold 90 is a fresh food stirring fan 110. Stirring fan 110 is adapted to receive a combined flow of air from recirculation ducts 94 and 95, as well as intake duct 100, and to disperse the combined flow of air into the fresh food compartment 43. In accordance with the most preferred form of the invention, stirring fan 110 is operated continuously.

With this arrangement, stirring fan 110 draws in a flow of air, which is generally indicated by arrows A, through inlets 95 and 97 of ducts 94 and 96, and intake duct 100, while subsequently exhausting the combined flow of cooling air, represented by arrow B, through outlet 125. Most preferably, outlet 125 directs the air flow in various directions in order to generate a desired flow pattern based on the particular configuration of fresh food compartment 43 and any additional structure provided therein. The exact positioning of inlets 95 and 97 also depend on the particular structure provided. In one preferred embodiment, inlet 95 of duct 94 is located at a point behind at least one food storage bin (not shown) arranged in a bottom portion of fresh food compartment 43. The air flow past the storage bin is provided to aid in maintaining freshness levels of food contained therein. For this purpose, an additional passage leading from freezer compartment 40 into fresh food compartment 43 can be provided as generally indicated at 128. While not part of the present invention, the details of the storage bin are described in U.S. Pat. No. 6,170,276 which is hereby incorporated by reference.

In order to regulate the amount of cooling air drawn in from freezer compartment 40, a multi-position damper 130 is provided either at an entrance to or within intake duct 100. As will be discussed more fully below, when the cooling demand within fresh food compartment 43 rises, damper 130 opens to allow cooling air to flow from freezer compartment 40 to fresh food compartment 43 and, more specifically, into intake duct 100 to manifold 90 and stirring fan 110. A flow of air to be further cooled at evaporator 52 is lead into an intake 135 of a return duct 137. In the embodiment shown, return duct 137 is preferably located in the upper portion of fresh food compartment 43.

In accordance with the invention, this overall refrigeration system synergistically operates to both maintain the temperature within fresh food compartment 43 at a substantially uniform temperature preferably established by an operator and minimizes stratification of the temperature in fresh food compartment 43. In order to determine the cooling demand within freezer compartment 40 and fresh food compartment 43, a plurality of temperature sensors are arranged throughout refrigerator 2. Specifically, a freezer temperature sensor 140 is located in freezer compartment 40, a fresh food compartment temperature sensor 143 is mounted on shelf rail 46, an evaporator coil temperature sensor 150 is mounted adjacent to evaporator 52, and a sensor 155, which is preferably arranged in a position directly adjacent to an intake associated with condenser 61, is provided to measure the ambient air temperature. As indicated above, shelf rails 46 are preferably made of metal, thereby being a good conductor. As will become more fully evident below, other high conductive materials could be employed. In addition, shelf rails 46 preferably extend a substantial percentage of the overall height of fresh food compartment 43. In this manner, the temperature sensed by sensor 143 is representative of the average temperature within fresh food compartment 43. Certainly, an average temperature reading could be obtained in various ways, such as by averaging various temperature readings received from sensors located in different locations throughout fresh food compartment 43. However, by configuring and locating sensor 143 in this manner, an average temperature reading can be obtained and the need for further, costly temperature sensors is avoided. Actually, although not shown, freezer temperature sensor 140 is preferably provided at a corresponding shelf rail for similar purposes.

Figure 3:
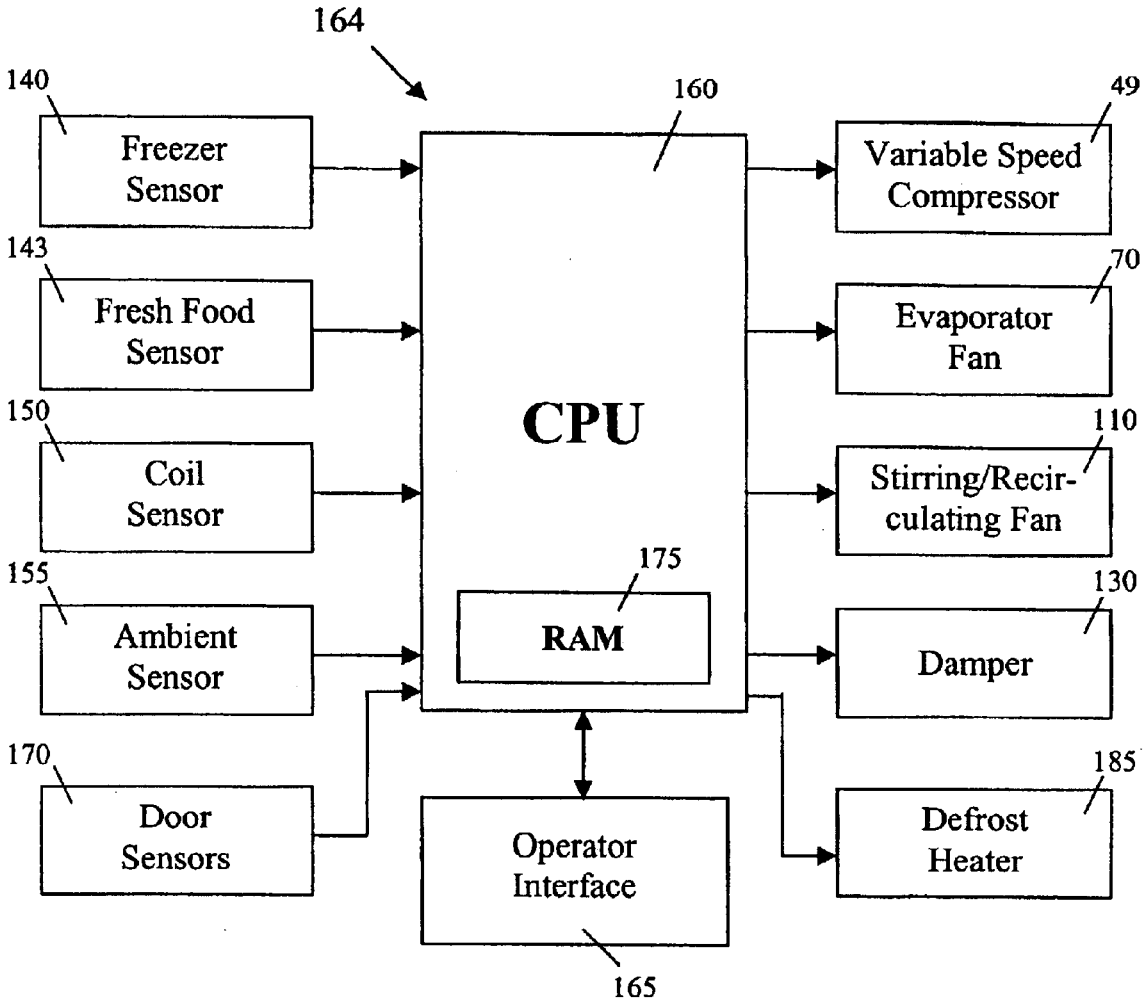
FIG. 3 is a block diagram depicting an overall control system employed in the refrigerator constructed in accordance with the present invention.

As shown in FIG. 3, a controller or CPU 160, forming part of an overall control system 164 of refrigerator 2, is adapted to receive inputs from each of the plurality of temperature sensors 140,143, 150 and 155, as well as operator inputs from an interface 165, and functions to regulate the operation of compressor 49, evaporator fan 70, and stirring fan 110, as well as the position for damper 130, in order to maintain a desired temperature throughout fresh food compartment 43. At this point, it should be noted that interface 165 can take various forms in accordance with the invention. For instance, interface 165 could simply constitute a unit for setting a desired operating temperature for freezer compartment 40 and/or fresh food compartment 43, such as through the use of push buttons or a slide switch. In one preferred form of the invention, although not shown in FIG. 1, interface 165 is constituted by an electronic control panel mounted on either door 6 or 10 to enter desired operating temperatures and a digital display to show temperature set points and/or actual compartment temperatures. The display could incorporate a consumer operated switch to change the displays from ° F. to ° C. and vise versa, various alarm indications, such as power interruption and door ajar indicators, service condition signals and, in models incorporating water filters, a filter change reminder. In any event, it is simply important to note that various types of interfaces could be employed in accordance with the invention.

In general, temperature fluctuations within refrigerator 2 can cover a broad spectrum. During a typical day, the doors 6 and 10 of refrigerator 2 can be opened several times and for varying periods of time as signaled by door sensors 170. Each time a door 6, 10 is opened, cold air escapes from a respective compartment 40, 43 and the temperature within the compartment 40, 43 is caused to rise. A certain temperature rise will necessitate the activation of the refrigeration system in order to compensate for the cooling loss. However, each door opening does not release the same amount of cold air, and therefore a uniform level of temperature compensation will not be needed. Accordingly, control system 164 determines the required cooling load and maintains the temperature with first compartment 43 in a predetermined, small temperature range by regulating each of the compressor 49 and evaporator fan 70, along with establishing an appropriate position for damper 130. That is, CPU 160 regulates the component operation and establishes the proper damper position interdependently, as will be detailed below, thereby obtaining synergistic results for the overall temperature control system. In fact, it has been found that fresh food compartment 43 can be reliably maintained within as small a temperature range as 1 ° F. (approximately 0.56° C.) from a desired set point temperature in accordance with the invention.

As indicated above, temperature sensor 143 monitors the average temperature at shelf rail 146 and sends representative signals to CPU 160 at periodic intervals to reflect an average temperature within fresh food compartment 43. CPU 160 preferably takes a derivative of the sensed temperatures to develop a temperature gradient or slope representative of a rate of change of the temperature within fresh food compartment 43.

CPU 160 will send a signal to operate damper 130. When instructed, damper 130 will open to allow an appropriate amount of additional cooling air to flow into fresh food compartment 43 from freezer compartment 40. Therefore, the position of damper 130 is established based on the temperature in fresh food compartment 43 as measured by sensor 143. Damper 130 will be maintained in an open position until temperature sensor 143 sends a signal to CPU 160 indicating the average temperature within fresh food compartment 43 has returned to the desired level, but can be closed when the temperature in fresh food compartment 43 is heading toward the correct, set point direction.

Of course, there will be requirements for additional cooling to be performed within freezer compartment 40 in order to enable lower temperature air to flow through intake duct 100. In these times, CPU 160 will operate compressor 49 and evaporator fan 70. Specifically, CPU 160 regulates the operation of variable speed compressor 49 based on the temperature in freezer compartment 40 as relayed by sensor 140, as well as the operator setting for a desired operating temperature for freezer compartment 40 as received from interface 165. Based upon the magnitude of the temperature deviation, compressor 49 will be operated at a speed, determined by CPU 160 to minimize energy usage and to rapidly return the temperature within freezer compartment 40 to within a pre-selected range based on the operator setting. Additionally, other compartment temperatures and desired settings may influence the compressor speed. CPU 160 further controls evaporator fan 70 based on at least temperatures sensed by evaporator temperature sensor 150 arranged at the coils of evaporator 52, the operation of compressor 49 and signals from door sensors 170. In general, evaporator fan 70 operates at a first speed when compressor 49 is on and at a lower speed when either of freezer or fresh food doors 6 and 10 are open as signaled by sensors 170, while being off if the temperature signaled by evaporator temperature sensor 150 is above a predetermined limit, e.g., 23° F.

Further details of the overall operation of the refrigeration system employed in refrigerator 2 are presented in U.S. Patent Applications entitled "Variable Speed Refrigeration System" and U.S. Patent Application entitled "Temperature Control System For A Refrigerated Compartment," both filed in even date herewith and incorporated herein by reference. The present invention is directed more particularly to a defrost control system for refrigerator 2 such that the above description is basically provided for the sake of completeness. To this end, reference will now be made to FIGS. 1–3 in describing the preferred method of operation of the defrost control of the present invention. During a typical day, doors 6 and 10 of refrigerator 2 will be opened several times. However, the frequency of occurrence of the openings will not be identical for each hour of the day. In addition, the frequency of use will almost certainly vary from day to day. In any event, in accordance with the invention, it is desired to operate an automatic defrost cycle when a door opening is not likely to occur. In this manner, an inherent raising of the temperature of evaporator 52 during defrost to remove accumulated frost will be least likely to alter the temperature in freezer and fresh food compartments 40 and 43 and therefore the potential impact on food contained within refrigerator 2 can be minimized.

To accomplish this desired function, sensors 170 are arranged such that each time doors 6 and 10 are opened, a signal is sent to CPU 160 and subsequently stored in a random access memory (RAM) 175. More specifically, CPU 160 functions to group the signals in one hour usage blocks within memory 175. Accordingly, each door opening is stored in one of twenty-four usage blocks such that the sum of the blocks equates to a day. CPU 160 determines the number of signals stored in each usage block and stores the usage blocks in one of two categories. The first category designates periods of high usage and the second, periods of low usage. Of the twenty-four usage blocks, at most, six of the blocks will be categorized as high use at any one time. If more that six usage blocks indicate periods of high usage, the six blocks representative of the periods of highest use are kept in the first category. In this manner, CPU 160 can develop a usage profile for refrigerator 2. Seven daily patterns or more can be used to determine an overall usage routine. In addition, the usage blocks can be grouped into logical patterns, such as weeks, months and years.

In accordance with a preferred embodiment of the present invention, refrigerator 2 is pre-set with an initial period after which a defrost cycle is activated. More specifically, upon the initial activation of refrigerator 2, CPU 160 will begin to count and store the run time of compressor 49. Once CPU 160 has determined that compressor 49 has operated for a preset period of time, CPU 160 will initiate a defrost cycle. That is, CPU 160 will activate a defrost heater 185 arranged adjacent evaporator 52 and deactivate compressor 49 to initiate the defrost cycle. At this point, it should be recognized that the use of defrost heater 185 is an optional feature and provided only as a means to expedite the defrost process.

During a defrost cycle, damper 130 is preferably closed. In fact, even immediately following the defrost cycle, damper 130 is maintained in a closed position such that warm air developed within freezer compartment 40 is trapped therein. Also, stirring fan 110 is preferably operated continuously such that cooling air within fresh food compartment 43 is maintained at or as close to the set point as possible, while thermal stratification is essentially avoided. In this manner, the temperature of the air within the respective compartment 40, 43 is less likely to rise and have a negative impact on the food stored therein.

In the most preferred form of the invention, prior to activating the defrost cycle, CPU 160 activates compressor 49 such that the temperature of freezer compartment 40 is lowered below a set point temperature selected by the consumer. In this manner, when the defrost cycle is activated and compressor 49 is dormant, the temperature in freezer compartment 40 will not rise above the set point such that stored foodstuffs will not spoil.

As discussed previously, refrigerator 2 is preferably preset at the factory to activate the defrost cycle after a period of compressor run time, e.g. 6 hours. However, if this period is let to stand, it is highly likely that refrigerator 2 will be prematurely run through various defrost periods. Obviously, this will undesirably increase the energy consumption of refrigerator 2. Accordingly, in the most preferred embodiment, CPU 160 records the length of time each defrost cycle is operated. Testing has shown that this information is inversely correlated to the amount of compressor run time required between subsequent defrosts. Accordingly, if the duration of defrost cycles, as measured by the activation period of defrost heater 185, decreases over time, the amount of compressor run time between cycles is allowed to increase from the default setting.

In this manner, the defrost control of the present invention optimizes the amount of defrost energy required based on ambient conditions and consumer usage. However, if the need for a defrost cycle is indicated, the actual cycle time is set for the period of low usage and, most preferably, the period of least usage as determined by CPU 160. Therefore, if CPU 160 determines that refrigerator 2 will be in a high usage period when a defrost cycle is indicated, the activation of the defrost cycle is performed during a low usage period, preferably when the period of least usage has been reached. Upon completion of a defrost cycle, as measured by a rise in temperature by sensor 150, a wait or drip period can be employed before re-activating compressor 49 in order to allow a sufficient drop in the temperature of defrost heater 185. In the most preferred form of the invention, the defrost cycle is terminated by de-activating defrost heater 185 when sensor 150 reads a temperature warm enough to detect all the ice being melted in the evaporator coil, e.g. 45° F. (approximately −1° C.). This defrost time is then registered in CPU 160. Due to the utilization of defrost heater 185, the maximum defrost period should not exceed thirty minutes. Thereafter, the drip period, preferably in the order of 2–4 minutes, is employed. The compressor 49 is then operated, preferably at maximum speed to rapidly bring the temperature in freezer compartment 40 down. At this time, CPU 160 functions to maintain evaporator fan 70 de-activated and damper 130 closed until sensor 150 reflects a temperature at evaporator 52 of below a predetermined temperature as measured by sensor 150.

With this arrangement, the time between defrosts, i.e. the run time of compressor 49 between successive defrost periods, is adjusted to optimize overall system performance. In general, if the time needed to complete a current defrost cycle is less than a limit established based on a prior defrost cycle, then the time between defrosts will be increased in proportion to this difference. However, provisions are also preferably made to activate an emergency defrost cycle if compressor 49 runs at maximum speed for a large percentage of the time between defrosts (TBD). In accordance with the most preferred form of the invention, an emergency defrost, i.e. a defrost cycle which is implemented prior to expiration of the established compressor run time between defrosts, will be performed when compressor 49 runs at maximum speed for greater than 1 +12/TBD hours. If an emergency defrost is required, the time between defrosts is preferably reset to the initial preset time period, e.g., 6hours.

Based on the above, it should be readily apparent that the invention provides for an defrost system of the type which minimizes temperature effects on food stored within refrigerator 2 by activating the system only during periods of low usage. Adverse effects on the food are further reduced by lowering the freezer temperature prior to activating the defrost cycle in order to develop thermal inertia which prevents freezer temperatures from elevating above the set point. This function is preferably performed by closing the variable position damper for the entire defrost operation and by providing a continuously operating stirring fan in the fresh food compartment to eliminate temperature stratification in the fresh food compartment during operation of the defrost cycle. Additionally, by tracking the duration of the defrost cycles, and timing subsequent cycles in proportion to the duration of prior cycles, the time differential between defrosts is optimized. A refrigerator constructed in accordance with the present invention reduces the effects of temperature changes on the food contained within the refrigerator, as well as reduces overall energy consumption. In any event, although described with reference to a preferred embodiment of the invention, it should be understood that various changes and/or modifications can be made to the invention without departing from the spirit thereof. Instead, the invention is only intended to be limited by the scope of the following claims.

We claim:

1. A refrigerator comprising:

a cabinet shell having defined therein freezer and fresh food compartments;

a refrigeration system for developing a flow of cooling air used to cool each of the freezer and fresh food compartments;

first and second doors provided to selectively seal the freezer and fresh food compartments respectively;

at least one sensor for providing signals indicative of opening times for at least one of the first and second doors;

a defrost system including a defrost heater provided to remove accumulated frost in the refrigeration system; and control means for regulating the refrigeration and defrost systems, said control means receiving the signals from the at least one sensor and storing the signals in memory to establish an opening pattern of the at least one door and a period of low usage of the refrigerator based on the opening pattern, said control means activating the defrost system during the period of low usage, while concurrently de-activating the refrigeration system.

2. The refrigerator according to claim 1, wherein at least a portion of said memory is divided into 24 usage blocks, with each usage block representing a particular hour of a day, said signals being stored in respective ones of said usage blocks for establishing the period of low usage.

3. The refrigerator according to claim 2, wherein the usage blocks are grouped into logical patterns selected from the group consisting of weeks, months and years.

4. The refrigerator according to claim 2, wherein said control means determines the period of low usage by grouping the signals indicating door openings into the usage blocks.

5. The refrigerator according to claim 4, wherein, at most, six of the usage blocks are designated as periods of high usage.

6. The refrigerator according to claim 1, wherein, upon establishing a need for a defrost operation, said control means operates the refrigeration system to lower a temperature of at least one of the compartments below a desired operating set point prior to activating the defrost system.

7. The refrigerator according to claim 1, wherein said control means adjusts a time period between successive operations of the defrost system based upon a duration of defrost heater activation.

8. The refrigerator according to claim 1, wherein the refrigeration system includes a stirring fan located in the fresh food compartment, said control means regulating said stirring fan to create a recirculating air flow within the fresh food compartment during a defrost cycle.

9. The refrigerator according to claim 1, wherein said refrigeration system includes a compressor, a condenser, an evaporator, an evaporator fan, a stirring fan, and a damper, said refrigerator further comprising a sensor for measuring a temperature at the evaporator and signaling the temperature to the control means, wherein said control means maintains the evaporator fan de-activated and the damper closed until the temperature at the evaporator cools below a freezer set point temperature following a defrost cycle.

10. In a refrigerator including freezer and fresh food compartments, each having a respective access door, a refrigeration system for developing a flow of cooling air used to cool each of the compartments, and a defrost system including a defrost heater for performing a defrost cycle for the refrigeration system, a method of controlling the defrost cycle comprising:

sensing compartment door opening times;

storing the door opening times in a designated one of a plurality of usage blocks of a memory;

categorizing the usage blocks into periods of high and low usage based upon a number of door openings in a given time period;

sensing a need for a defrost cycle;

determining if the refrigerator is in a high usage period or a low usage period;

de-activating the refrigeration system; and initiating the defrost cycle if the appliance is in a low usage period.

11. The method of claim 10, further comprising: activating a defrost heater to expedite the defrost cycle.

12. The method of claim 11, further comprising: adjusting a time period between successive defrost cycles based upon a duration of defrost heater activation.

13. The method of claim 10, further comprising: lowering the temperature of the freezer compartment below a set point prior to initiating the defrost cycle.

14. The method of claim 10, further comprising: setting a time for the defrost cycle based upon a time duration of at least one previously completed defrost cycle.

15. The method of claim 10, wherein the memory is divided into 24 usage blocks, each representing a particular hour of a day, wherein the door opening times are stored in respective ones of said usage blocks for establishing the period of low usage.

16. The method of claim 15, further comprising: grouping the usage blocks into logical patterns selected from the group consisting of weeks, months and years.

17. The method of claim 15, further comprising: determining the period of low usage by grouping the door opening times into the usage blocks.

18. The method of claim 17, further comprising: designating, at most, six of the usage blocks as periods of high usage.

19. The method of claim 10, further comprising: operating a stirring fan located in the fresh food compartment to create a recirculating air flow within the fresh food compartment throughout the defrost cycle.

20. The method of claim 10, wherein the refrigeration system includes a compressor, a condenser, an evaporator, an evaporator fan, a stirring fan, and a variable position damper, said method further comprising:

measuring a temperature at the evaporator; and maintaining the evaporator fan de-activated and the damper closed until the temperature at the evaporator cools below a freezer set point temperature following the defrost cycle.

* * * * *